United States Patent [19]

Schulz

[11] Patent Number: 4,831,355

[45] Date of Patent: May 16, 1989

[54] ARRANGEMENT FOR ESTABLISHING ELECTRICAL CONTACT WITH RESISTANCE PATHS

[76] Inventor: Klaus-Dieter Schulz, Ilgenweg 11a, 1000 Berlin 474 (West), Fed. Rep. of Germany

[21] Appl. No.: 117,201

[22] PCT Filed: Jan. 16, 1987

[86] PCT No.: PCT/EP87/00018

§ 371 Date: Nov. 30, 1987

§ 102(e) Date: Nov. 30, 1987

[87] PCT Pub. No.: WO87/04848

PCT Pub. Date: Aug. 13, 1987

[30] Foreign Application Priority Data

Jan. 31, 1986 [DE] Fed. Rep. of Germany ..... 3603369

[51] Int. Cl.[4] ..... H01C 10/32

[52] U.S. Cl. ..... 338/162; 338/163; 338/164; 338/171

[58] Field of Search ..... 338/162–171

[56] References Cited

U.S. PATENT DOCUMENTS 3,772,629 11/1973 Meylan-Rochet ..... 338/154

FOREIGN PATENT DOCUMENTS 746421 5/1933 France .

*Primary Examiner*—E. A. Goldberg
*Assistant Examiner*—M. M. Lateef
*Attorney, Agent, or Firm*—Lee & Smith

[57] ABSTRACT

An arrangement for ensuring contact between resistance paths comprises a base of electrically non-conductive and elastically deformable material such as rubber. To the base is applied an electrically conductive coating. The resistance path is pressed against this layer by means of a covering element, the base being subjected to preloading. In this way, the contact can be ensured between a potentiometer resistance with terminal connections and a plug, around which a short-circuit interval is provided.

8 Claims, 1 Drawing Sheet

ARRANGEMENT FOR ESTABLISHING ELECTRICAL CONTACT WITH RESISTANCE PATHS

TECHNICAL FIELD

The invention relates to an arrangement for establishing electrical contact with resistance paths.

BACKGROUND ART

In particular, the invention is directed to the problem of connecting potentiometer windings, passing taps out from potentiometer windings and providing short-circuit intervals at potentiometer windings what is required in some applications. According to prior art such connections are established by soldering tin. This involves expensive procuction and with crome nickel wires, for example, is possible with greatest difficulties only. Also establishing extended short-circuit intervals becomes very expensive.

By U.S. Pat. No. 3,377,606, a potentiometer is known having a circular housing bottom formed as synthetic plasic part made by injection moulding, in which housing bottom a coiled arcuate resistance body is located. Connection contact pins are embeded in the housing bottom by injection moulding. Contact pieces formed as punched elements made of sheet metal are connected to the resistance body and to the connection contact pins and are located in recesses of the housing bottom. A covering element consists of a ductile outer element in the form of a metal sheet element and a rubber-resilient coating located in this ductile outer element. The covering element is connected to the housing bottom by beading. Thereby the rubber-resilient coating effects sealing. Besides the rubber-resilient coating, on the opposite side of the contact pieces, engages the resistance body. Hereby the resistance body is held in the housing.

DISCLOSURE OF THE INVENTION

Therefore, it is an object of the invention to provide an arrangement for establishing electrical contact with resistance paths, which arrangement can be produced simply and permits easy adaption to the requirements of the respective cases of application.

According to the invention this object is achieved by (a) a base of electrically non-conductive and resiliently deformable material, (b) an electrically conductive coating applied to the base, and (c) means for pressing the resistance patch against this layer, the base being subjected to preload.

Modifications of the invention are subject matter of the sub-claims.

BRIEF DESCRIPTION OF THE INVENTION

An embodiment of the invention is described in further details with reference to the accompanying drawings.

PREFERED EMBODIMENT OF THE INVENTION

Figure 1:
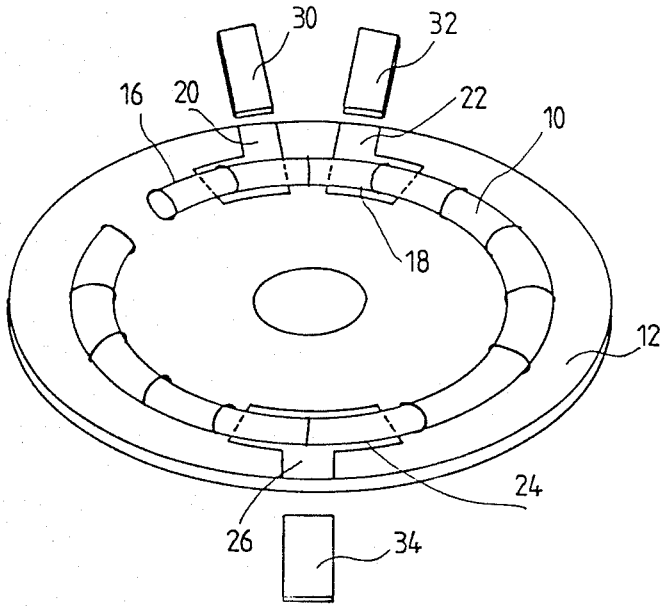
FIG. 1 is a perspective illustration and shows an arrangement for establishing electrical contact with a potentiometer or resistance winding.
Figure 2:
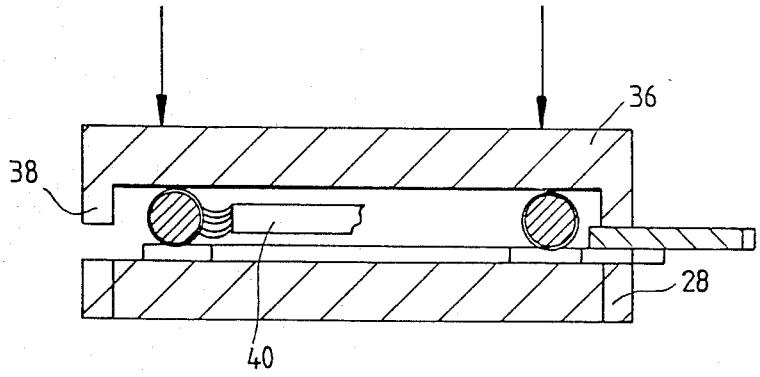
FIG. 2 is a sectional view of the potentiometer.

The arrangement for establishing electrical contact with resistance paths 10, in this case a potentiometer or resistance winding, comprises a base 12 made of electrically non-conductive and resiliently deformable material. In the described embodiment, the base 1 is a disc made of rubber. Naturally also a similar synthetic plastics disc can be used. An electrically conductive coating is applied to the base. In the preferred embodiment, this electrically conductive coating consists of a conductive silver layer which is applied to the base 12 by means of silk screen-printing. In the described embodiment, the electrically conductive coating comprises arcuate sections 16 and 18 in the area of the ends of the potentiometer winding forming the resistance path 10 and, adjacent thereto, tongues 20,22 extending radially outwards. Furthermore the electrically conductive coating comprises an arcuate section 24 in the central area of the potentiometer winding forming the resistance path 10. This arcuate area is relatively long and forms a short-circuit interval. Besides the electrically conductive coating has a tongue 26 connected to the arcuate section 24 and extending radially outwards. The resistance path 10 is placed on the base 12 such that the arcuate sections 16, 18 and 24 engage the bottom of the resistance path 10.

The resistance path 10 with the base 12 is supported on a housing base plate 28.

Flat connection contacts 30 or 32, respectively, (Faston connectors, for example) extending radially outwards are supported on the tongues 20 and 22 in the area of the ends of the resistance path 10. Corresponding a flat connection contact 34 extending radially outwards is supported on the tongue 26.

Means for pressing the resistance path 10 against the electrically conductive coating, the base 12 being subjected to preload, comprise the housing base plate 28 and a covering element 36 having an edge 38 projecting towards the housing base plate 28. This covering element 36 is supported on the resistance path 10 and tightened relative to the housing base plate 28. Thereby the elastic base 12 is deformed slightly such that the base is adapted to the shape of the resistance path, and subjected to preload, establishes good contact between the electrically conductive coating 16, 18, 24 applied to the base and the resistance path 10. Correspondingly the flat connection contacts 30, 32, 34 are pressed against the tongues 20, 22 or 26, respectively, of the electrically conductive coating by the projecting edge 38 of the covering element 36 such that a firm contact is ensured.

A slider 40 engages the inner side of the potentiometer winding forming the inner side of the resistance path 10.

I claim:

1. A resistor arrangement, with a housing and a resistor arranged in said housing, said resistor being in electrical contact with housing-fixed conductors at fixed locations along its length, the improvement comprising:

a support layer of electrically non-conductive and resiliently deformable material arranged in said housing and supported thereby, said resistor being in contact with said support layer along a contact path, an electrically conductive coating applied to said support layer in separate areas located on said contact path, the coating in each of said areas forming part of one said housing-fixed conductors, and means for urging said resistor into contact with said support layer along all of said contact path to deform said support layer resiliently and to provide close contact between said areas of electrically conductive coating and said resistor.

2. An arrangement as claimed in claim 1, wherein said electrically conductive coating is a silver layer.

3. An arrangement as claimed in claim 2, wherein said silver layer is silk screen printed.

4. An arrangement as claimed in claim 3, wherein said support layer is a rubber disc.

5. An arrangement as claimed in claim 1, wherein said urging means comprise:

a housing base plate, on said support layer is supported, and a cover having an edge projecting towards said housing base plate, said cover being in contact with said resistor on the side remote from said housing base plate and being tightened against said housing base plate, whereby said edge engages said housing base plate and said support layer is resiliently deformed to provide said close contact between said areas of electrically conductive coating and said resistor.

6. An arrangement as claimed in claim 5 wherein said resistor is a potentiometer winding, said areas of electrically conductive coating comprise arcuate sections near the ends of said potentiometer winding and radial tongues communicating therewith and extending radially outwardly therefrom, and flat terminal elements are provided extending radially outwardly and being supported at their inner ends on said tongues, said projecting edge of said cover engaging each terminal element to urge it against one of said radial tongues.

7. An arrangement as claimed in claim 6, wherein an area of said electrically conductive coating comprises an arcuate section near the center of said potentiometer winding to establish a short-circuit interval.

8. An arrangement as claimed in claim 6, wherein said areas of electrically conductive coating comprise an arcuate section near the center of said potentiometer winding and a central tongue communicating therewith and extending radially outwardly therefrom, and a flat central terminal element is provided extending radially outwardly and being supported at its inner end on said central tongue, said projecting edge of said cover engaging said central terminal element to urge it against said central tongue, whereby a center tap is provided on said potentiometer winding.

* * * * *